United States Patent [19]

Carlson

[11] 4,310,214

[45] Jan. 12, 1982

[54] TILTABLE TERMINAL CLAMP ASSEMBLY

[76] Inventor: William R. Carlson, 221 Holidonhill Dr., Cincinnati, Ohio 45238

[21] Appl. No.: 132,400

[22] Filed: Mar. 21, 1980

[51] Int. Cl.[3] ..... H01R 4/44

[52] U.S. Cl. ..... 339/246; 339/263 R

[58] Field of Search ..... 339/246, 263 R, 95 R

[56] References Cited

U.S. PATENT DOCUMENTS

| | | | |
|---|---|---|---|
| 3,065,442 | 11/1962 | Hubbell | 339/246 X |
| 3,177,456 | 4/1965 | Haydu et al. | 339/95 R |
| 3,398,393 | 8/1968 | Cochrum | 339/246 |
| 3,891,296 | 6/1975 | Gutshall | 339/246 |
| 4,135,777 | 1/1979 | Barth | 339/95 R X |

*Primary Examiner*—Joseph H. McGlynn

*Assistant Examiner*—Frank H. McKenzie, Jr.

*Attorney, Agent, or Firm*—Vernon J. Pillote

[57] ABSTRACT

A tiltable terminal clamp assembly including a screw having a circular protrusion on the underhead surface and a clamp plate of generally rectangular configuration having a central aperture dimensioned to loosely receive the shank of the screw and four angularly spaced raised embossments projecting above the upper surface of the clamp plate and extending outwardly from the central aperture toward the four corners of the clamp plate for engagement with the circular protrusion on the head of the screw. The raised embossments have a maximum height and width adjacent the aperture and decrease in height and width in a direction outwardly of the aperture in the clamp plate.

8 Claims, 6 Drawing Figures

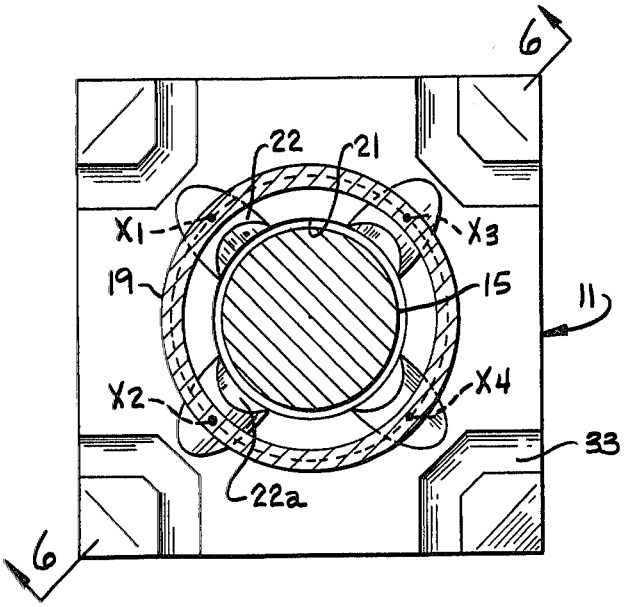
Fig. 4.
Fig. 6.
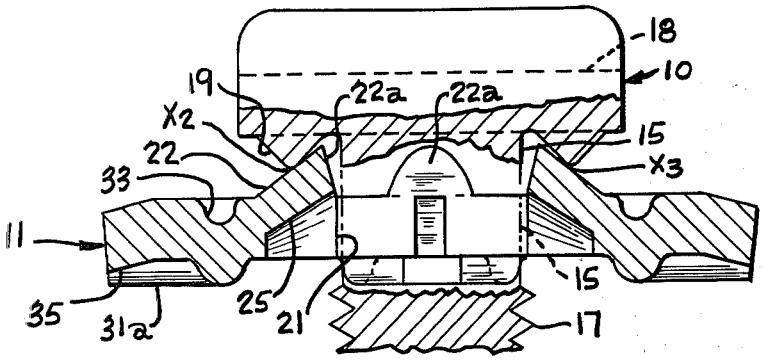
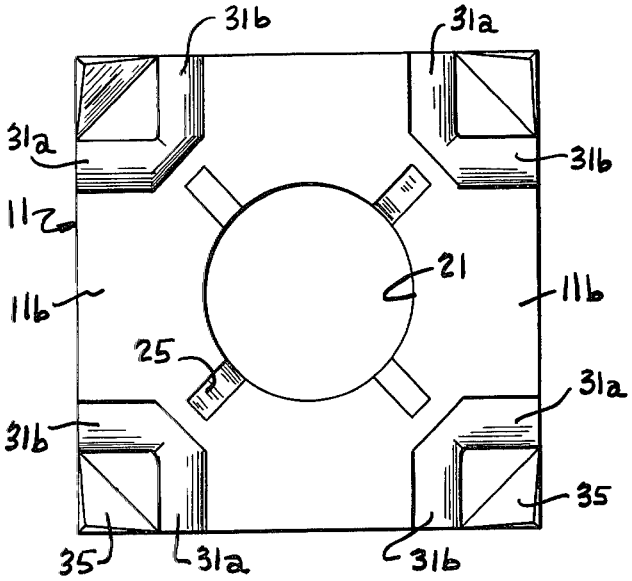
Fig. 5.

TILTABLE TERMINAL CLAMP ASSEMBLY

BACKGROUND OF THE INVENTION

The present invention relates to terminal clamp assemblies for clamping one or two wires, including pairs of wires of different size, to a terminal member. Such terminal clamp assemblies commonly include a screw and a clamp plate loosely mounted on the screw shank for tilting or teetering relative to the shank to accommodate wires of different size. In order to enhance the clamping action on wires of relatively different size, it has heretofore been proposed as disclosed in U.S. Pat. No. 3,891,296 to provide a circular protrusion on the underside of the head of the screw and a raised frusto-conical surface on the upper side of the clamp plate engageable with the circular protrusion on the head in different tilted positions of the clamp plate. The clamp plate in that patent, however, also had a generally frusto-conical depression in the underside of the clamp plate, produced as a consequence of forming the raised frusto-conical surface on the upper side of the clamp plate. In order to overcome the problem of delayed lifting of the clamp plate during unthreading of the screw, caused by the frusto-conical recess in the underside of the clamp plate, the frusto-conical portion of the clamp plate was flattened in four narrow areas to form inwardly extending ribs arranged to engage a collar on the shank of the screw and lift the clamp plate when the screw was unthreaded. However, these four narrow ribs sometimes tended to tilt or bind on the collar on the shank of the screw, unless the collar was made very large. The terminal clamp assemblies are commonly installed by automatic machinery in the terminal boards and the terminal boards frequently have a large number of terminal clamp assemblies thereon. Even one faulty terminal clamp assembly can make the terminal board unfit for use and such terminal boards containing a faulty terminal clamp assembly had to be either discarded or set aside and manually reworked to correct the defective terminal clamp assembly.

The clamp plate shown in Pat. 3,891,296, also required very substantial material movement in order to form the frusto-conical raised surface on the upper side of the clamp plate for engagement with the protrusion on the head of the screw, and to also form the inwardly extending ribs at the underside of the clamp plate for engagement with the collar on the shank of the screw. The amount of material movement required in forming the clamp plate in the aforementioned patent adversely affected die life. In addition, there was some shearing or tearing of the clamp plate at the junctures between the ribs and frusto-conical sections and which reduced the strength of the clamp plate.

SUMMARY OF THE INVENTION

Various important objects of this invention are to provide a tiltable terminal clamp assembly of the type in which the screw has a circular protrusion on the underside of the head spaced outwardly from the shank and in which the clamp plate has an improved protrusion engaging surface at its upper side and which provides a rounder aperture in the clamp plate for better retention of the clamp plate on the shank of the screw; which provides a flatter wire contact area at the underside of the clamp plate; which improves tiltability of the clamp plate relative to the shank of the screw to accommodate wires of relatively different size; which improves equalization of pressure applied to the clamp plate to wires of different size; and which minimizes material movement required in forming the clamp plate for beter die life.

Accordingly, the present invention provides a tiltable terminal clamp assembly for securing at least one conductor to a terminal member comprising, a screw having a shank and a head at one end of the shank, the head having an underhead surface with an integral substantially circular protrusion spaced radially outwardly from the shank, a generally rectangular clamping plate having a generally flat central section and an aperture in the central section dimensioned to loosely and tiltably receive the shank of the screw adjacent the head, the shank having threads commencing at a location below the plate and extending toward the free end of the shank for threading into a terminal member, characterized in that the plate has four angularly spaced raised embossments projecting above the upper surface of the central section and extending outwardly from the central aperture toward the four corners of the clamp plate for engagement with the circular protrusion on the head of the fastener, the raised embossments having a maximum height adjacent the central aperture and decreasing in height in a direction outwardly of the aperture, the generally flat central section of the plate having four angularly spaced depressions in the undersurface extending radially outwardly from the central aperture toward the four corners of the clamp plate each below a respective one of the angularly spaced raised embossments, the angular width of the depressions at the ends adjacent the aperture being small as compared to the angular spacing between adjacent ones of the depressions.

These, together with other objects, features and advantages of this invention will be more readily understood by reference to the following detailed description upon reference to the accompanying drawings wherein:

FIG. 4 is a horizontal sectional view through the terminal clamp assembly taken on the plane 4—4 of FIG. 2;

FIG. 5 is a horizontal sectional view through the terminal clamp assembly taken on the plane 5—5 of FIG. 2; and FIG. 6 is a vertical sectional view through the terminal clamp assembly taken on the plane 6—6 of FIG. 4.

Figure 1:
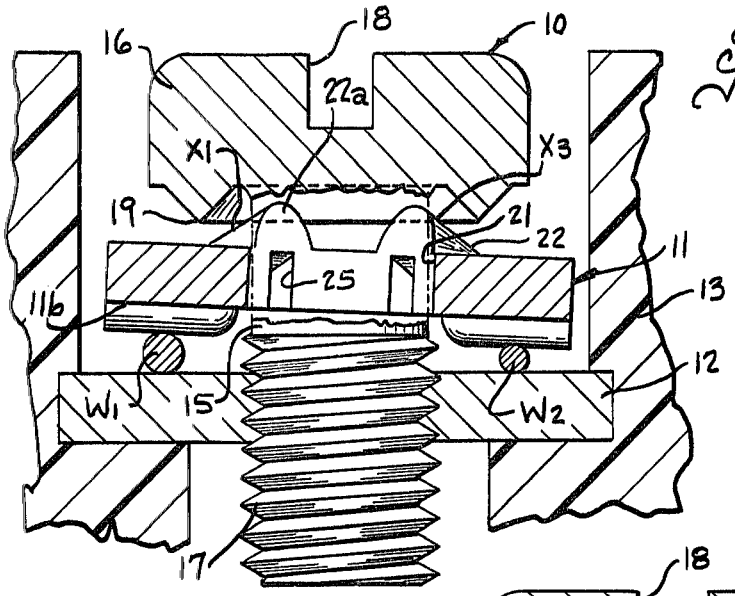
FIG. 1 is a vertical sectional view showing on an enlarged scale, the teeter terminal clamp of the present invention threaded into a terminal member for clamping a pair of conductors of different size.
Figure 2:
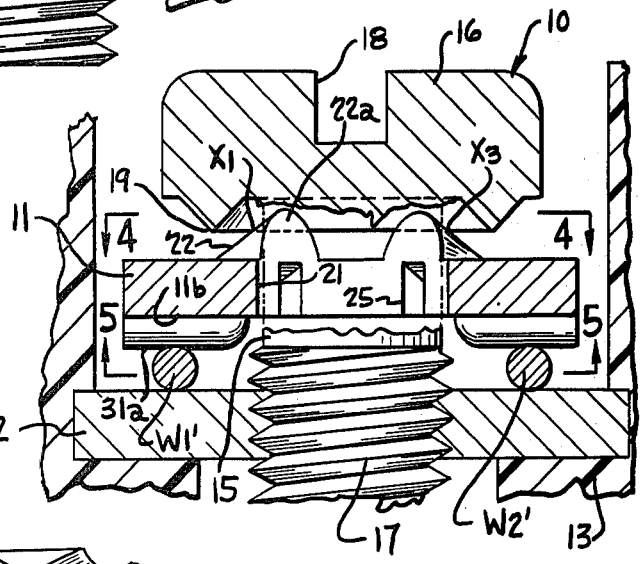
FIG. 2 is a fragmentary vertical sectional view showing the tiltable terminal clamp assembly of the present invention threaded into a terminal member for clamping a pair of conductors of like size.
Figure 3:
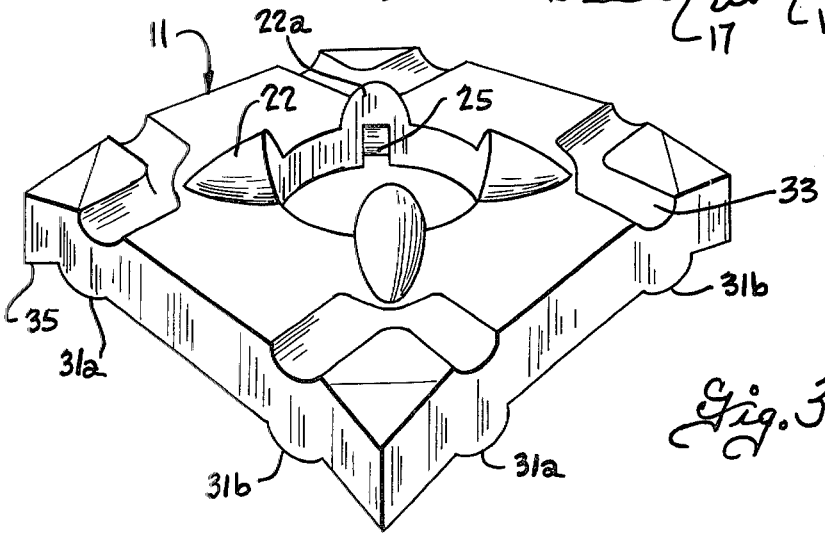
FIG. 3 is a perspective view of the clamping plate of the terminal clamp assembly.

The tiltable terminal clamp assembly in general includes a screw 10 and a clamp plate 11 for clamping one or two wires such as indicated at $W_1$ and $W_2$ in FIG. 1, and $W_1$, and $W_2'$ in FIG. 2 to a terminal member 12. The terminal member 12 is of an electrically conductively material and is commonly mounted in a terminal board 13 of electrical insulating material such as plastic or the like. It is necessary to firmly clamp the wires to the conductive terminal member 12 to not only establish a good electrical conduction path between the wires, but to also withstand loosening of the wires due to tension forces and/or vibration.

The screw 10 includes a shank 15 having a head 16 at one end and threads 17 on the shank commencing at a point below the plate 11 and extending to the free end of the shank for threaded engagement in the terminal member 12. The head has provision for driving the same and, as shown, has a slot 18, it being understood that other means such as a multi-sided socket or multi-sided outer periphery could be provided on the head for engagement with a driving tool. The head has a circular protrusion 19 formed on the underside of the head which is spaced radially outwardly from the shank so as to form an annular recess at the underside of the head between the protrusion and the shank. In the embodiment illustrated, the protrusion has a generally V-shaped cross-section.

The clamp plate 11 has a generally rectangular configuration and is preferably square as illustrated in the drawing. The plate has a central aperture 21 which is sufficiently larger than the cross-section of the shank of the screw to loosely and tiltably receive the shank of the screw in the region adjacent the head. The plate has a generally flat central section and four angularly spaced raised embossments 22 projecting above the upper surface of the central section and extending outwardly from the aperture 21 toward the four corners of the clamp plate. The raised embossments 22 are arranged to engage the circular protrusion 19 on the underside of the head of the screw and the raised embossments have a maximum height and width adjacent the central aperture and decrease in height and width in a direction outwardly of the aperture. The embossments are preferably formed to have a transversely arched configuration with a radius of curvature at all points therealong substantially less than the radial spacing from the center of the aperture so that only the apex of the transversely arched embossments engage the protrusion 19 on the head. In addition, the angle at which the apices of the embossments are inclined relative to the upper surface of the clamp plate is made slightly less than the angle that the inner surface of the protrusion 19 makes with the horizontal as best shown in FIG. 6, so that only the apex of the protrusion on the head engages the apices of the raised embossments 22 on the clamp plate.

As best shown in FIGS. 5 and 6, the clamp plate has four angularly spaced depressions 25 formed in the under surface thereof that extend radially outwardly from the center aperture toward the four corners of the clamp plate and each below a respective one of the angularly spaced raised embossments 22. The depressions 25 have a width substantially narrower than the width of the raised embossments 22 and the depressions decrease in depth in a direction outwardly from the aperture, as best shown in FIG. 6, so that the embossments have the form of a continuous unbroken arch at the upper side of the clamp plate. In addition, the width of the depressions 25 is small as compared to the angular spacing between the depressions so that the aperture 21 in the clamp plate remains substantially circular and is substantially continuous except for the small interruptions produced by the narrow depressions. This facilitates retention of the clamp plate on the shank of the screw and the clamp plate can be retained on the shank of the screw by merely rolling the threads on the screw until the threads have a crest diameter sufficiently greater than the diameter of the aperture 21. Alternatively, a separate collar such as shown in the aforementioned Pat. 3,891,296 could be provided on the shank.

Conductor engaging embossments are preferably provided on the underside of the clamp plate for enhancing resistance to pull-out of the conductors. The conductor engaging embossments 31 are preferably provided adjacent the four corners of the clamp plate radially outwardly from the ends of the raised embossments 22 on the upper surface of the clamp plate. In the embodiment shown, the conductor engaging embossments 31 include pairs of embossments **31*a*, 31*b* at each corner of the clamp plate. Embossments 31*a* extend transverse to one side edge of the clamp plate adjacent the corner and the embossments 31*b* extend transverse to the other side edge of the clamp plate adjacent the corner. The corners of the clamp plate can be further coined or struck over intermediate the embossments 31*a* and 31*b* at a shallow angle as indicated at 35** to provide sharpened edges for engaging the conductors.

The clamp plates are formed by first punching an opening corresponding to the aperture 21 in the clamp plate and then forming the clamp plate in a stamping operation between opposed forming dies (not shown) shaped complementary to the upper and lower faces on the clamp plate. The depressions 25 in the clamp plate are formed by projections on one die member shaped and located complementary to the depressions 25 to force material in the clamp plate laterally into recesses formed in the face of a second forming die, which recesses are shaped complementary to the raised embossments 22. As previously described, the aperture 21 is formed in the clamp plate prior to forming the raised embossments 22, and the inner ends **22*a* of the embossments are inclined outwardly as best shown in FIG. 6. Similarly, projections are provided on the face of the second forming die shaped complementary to the depressions 33, to force material of the clamp plate laterally into recesses in the first mentioned forming die, which recesses are shaped and located complementary to the protrusions 31*a* and 31*b***.

The terminal clamps may be made in several different sizes using different size screws; for example, a number 4 clamp using a size 4 screw having 40 threads per inch; a number 6 clamp using a size 6 screw having 32 threads per inch; a number 8 clamp using a size 8 screw having 32 threads per inch; and a number 10 clamp using a size 10 screw having 32 threads per inch. In order to achieve proper tiltability of the clamp plant relative to the screw while utilizing the screw threads to retain the clamp plate against disassembly, the diameter of the clamp plate hole 21 is dimensioned larger than the diameter of the screw shank 15 and smaller than the crest diameter of screw threads 17 and may; for example, be dimensioned as follows:

| Screw Size | #4 | #6 | #8 | #10 |
|---|---|---|---|---|
| Clamp Plate Hole Dia. | .102 | .125 | .150 | .175 |
| Screw Blank Dia. | .096 | .115 | .143 | .167 |
| Thread Crest Dia. | .108 | .135 | .160 | .187 |

From the foregoing it is thought that the construction of the tiltable terminal clamp assembly and the manner of making and using the same will be readily understood. The screw blank head 16 and the annular protrusion 19 on the underside of the head can be formed in a simple heading operation. The clamp plate is formed in a stamping operation in which the aperture 21 is first punched out of the clamp plate and the embossments 22 thereafter formed between meeting die members which form the depressions 25 in the underside of the clamp plate and press the material laterally into recesses in the other die member to form the raised embossments 22. Similarly, the conductor engaging embossments 31 can be formed in the stamping operation. The clamp plate is then assembled on the screw blank and the threads 17 thereafter rolled on the shank of the screw. The threads themselves can be utilized to retain the clamp plate on the screw. Alternatively, a separate rolled rim can be formed on the shank for this purpose.

By reason of the small size of the raised embossments 22 and the depressions 25, only a small amount of material has to be moved in order to form the same and this improves the die life. In addition, the raised embossments 22 and depressions 25 extend outwardly from the aperture 21 toward the corners of the clamp plate so that the wire contact area of the clamp plate 11, that is the area designated **11*b*** between the wire engaging embossments on the underside of the clamp plate, remains generally flat.

It is considered that the provision of the raised embossments arranged to extend outwardly from the central aperture toward the four corners of the clamp plate, provides improved equalization of the pressure applied from protrusion 19 on the head of the screw through the clamp plate to the wires $W_1$ and $W_2$. In this regard it is to be noted that, when wires $W_1$ and $W_2$ of different size are clamped against the terminal member 12, the clamp plate tilts about a tilt axis generally parallel to and substantially medially between the wires. The points of contact between the protrusion 19 and the raised embossments 22, designated $X_1$–$X_4$, are located relatively closer to the tilt axis of the plate and intermediate the points of contact of the wires $W_1$ and $W_2$ with the underside of the clamp plate. Thus, a portion of the forces applied at points $X_1$ and $X_2$ at one side of the tilt axis of the clamp plate is applied to wire $W_1$ and a portion is also applied to wire $W_2$. Similarly, a portion of the forces applied at points $X_3$ and $X_4$ at the other side of the tilt axis of the clamp plate are applied in part to wire $W_2$, and in part wire $W_1$.

The embodiments of the invention in which an exclusive property of privilege is claimed are defined as follows:

1. A tiltable terminal clamp assembly for removably securing at least one conductor to a terminal member comprising, a screw having a shank and a head at one end of the shank, the head having an underhead surface with an integral substantially circular protrusion spaced radially outwardly from the shank, a generally rectangular clamping plate having a generally flat central section and a generally circular aperture in the central section dimensioned to loosely and tiltably receive the shank of the screw adjacent the head, the shank having threads commencing at a location below the plate and extending toward the free end of the shank for threading into a terminal member, the plate having four angularly spaced raised embossments projecting above the upper surface of the central section and extending outwardly from the central aperture toward the four corners of the clamp plate a distance greater than the radial spacing of the circular protrusion from the shank for engagement with the circular protrusion on the head of the screw, the raised embossments having a maximum height and width adjacent the central aperture and decreasing in height and width in a direction outwardly of the aperture, the generally flat central section of the plate having four angularly spaced depressions in the undersurface thereof extending generally radially outwardly from the central aperture toward the four corners of the clamp plate each below a respective one of the angularly spaced raised embossments, the width of the depressions at the ends adjacent the aperture being small as compared to the angular spacing between adjacent ones of the depressions.

2. A tiltable terminal clamp assembly according to claim 1 wherein the angularly spaced raised embossments have a transversely arched configuration with a radius of curvature at all points therealong substantially less than the radial spacing from the center of the aperture, the depressions in the underside of the clamp plate having a width measured circumferentially of the aperture which is substantially less than the circumferential width of the raised embossments at their juncture with the upper surface of the central section.

3. A tiltable terminal clamp assembly according to claim 1 wherein the threads on the shank have a crest diameter greater than the diameter of the aperture in the clamp plate and sufficient to engage the underside of the central section of the clamp plate and prevent passage of the clamp plate thereover.

4. A tiltable terminal clamp assembly according to claim 1 including conductor engaging anti-slip embossments projecting below the underside of the clamp plate adjacent each corner of the clamp plate.

5. A tiltable terminal clamp assembly for removably securing at least one conductor to a terminal member comprising, a screw having a shank and a head at one end of the shank, the head having an underhead surface with an integral substantially circular protrusion spaced radially outwardly from the shank, a generally rectangular clamping plate having a generally flat central section and a generally circular aperture in the central section dimensioned to loosely and tiltably receive the shank of the screw adjacent the head, the shank having threads commencing at a location below the plate and extending toward the free end of the shank for threading into a terminal member, the plate having four angularly spaced raised embossments projecting above the upper surface of the central section and extending outwardly from the central aperture toward the four corners of the clamp plate a distance greater than the radial spacing of the circular protrusion from the shank for engagement with the circular protrusion on the head of the fastener, the raised embossments having a maximum height and width adjacent the central aperture and decrease in height and width in a direction outwardly of the aperture, the raised embossments having a transversely arched configuration with a radius of curvature at all points therealong substantially less than the radial spacing from the center of the aperture, the generally flat central section of the plate having four angularly spaced depressions in the undersurface thereof extending generally radially outwardly from the central aperture toward the four corners of the clamp plate each below a respective one of the angularly spaced raised embossments, the width of the depressions being small as compared to the angular spacing between adjacent ones of the depressions and the depth of the depressions decreasing in a direction outwardly of the aperture.

6. A tiltable terminal clamp assembly according to claim 5 wherein the depressions have relatively parallel side walls spaced apart in a direction circumferentially of the aperture a distance substantially less than the circumferential width of the raised embossments at their juncture with the upper surface of the central section.

7. A tiltable terminal clamp assembly according to claim 5 wherein the threads on the shank have a crest diameter greater than the diameter of the aperture in the clamp plate and sufficient to engage the underside of the central section of the clamp plate and prevent passage of the clamp plate thereover.

8. A tiltable terminal clamp assembly according to claim 5 including conductor engaging anti-slip embossments projecting below the underside of the clamp plate adjacent each corner of the clamp plate.

* * * * *